United States Patent [19]

Boffardi

[11] 4,401,587

[45] Aug. 30, 1983

[54] AMINOMETHYLPHOSPHONIC ACID AND POLYMALEIC ANHYDRIDE COMBINATIONS FOR TREATING CORROSION

[75] Inventor: Bennett P. Boffardi, Bethel Park, Pa.

[73] Assignee: Calgon Corporation, Pittsburgh, Pa.

[21] Appl. No.: 331,448

[22] Filed: Dec. 16, 1981

[51] Int. Cl.[3] ..... C23F 11/18; C23F 11/14; C23F 11/16

[52] U.S. Cl. ..... 252/389 A; 106/14.12; 106/14.14; 106/14.15; 106/14.18; 210/697; 210/700; 252/8.55 E; 252/181; 422/16; 422/17; 422/18

[58] Field of Search ..... 252/389 A, 8.55 E, 181; 106/14.12, 14.13, 14.14, 14.15, 14.18, 14.21; 210/697, 700, 749; 422/16, 17, 18

[56] References Cited

U.S. PATENT DOCUMENTS

| | | | |
|---|---|---|---|
| 2,358,222 | 9/1944 | Fink et al. | 210/697 |
| 2,539,305 | 1/1951 | Hatch | 210/697 |
| 2,723,956 | 11/1955 | Johnson | 210/697 |
| 2,742,369 | 4/1955 | Hatch | 106/14.18 |
| 3,289,734 | 12/1966 | Robertson | 252/181 |
| 3,293,152 | 12/1966 | Herbert et al. | 252/180 |
| 3,434,969 | 5/1969 | Ralston | 252/180 |
| 3,483,133 | 12/1969 | Hatch et al. | 252/389 A |
| 3,578,589 | 5/1971 | Hwa et al. | 252/180 |
| 3,715,307 | 2/1973 | Johnson | 252/180 |
| 3,762,873 | 10/1973 | Oude Alink | 252/392 |
| 4,297,237 | 10/1981 | Boffardi | 252/389 A |

FOREIGN PATENT DOCUMENTS

| | | | |
|---|---|---|---|
| 854151 | 10/1970 | Canada | 252/389 A |

*Primary Examiner*—Irwin Gluck

*Attorney, Agent, or Firm*—Martin L. Katz; Michael C. Sudol; R. Brent Olson

[57] ABSTRACT

A method of inhibiting corrosion of low carbon steel in an aqueous system comprising treating said system with 1.0 to 300 parts per million by weight of the total aqueous content of said system, of a composition comprising aminomethylphosphonic acid compounds and polymaleic anhydride or amine adducts thereof in a weight ratio of from 10:1 to 1:10.

7 Claims, No Drawings

AMINOMETHYLPHOSPHONIC ACID AND POLYMALEIC ANHYDRIDE COMBINATIONS FOR TREATING CORROSION

BACKGROUND OF THE INVENTION

1. Field of the Invention

The present invention relates to a method of inhibiting the corrosion of low carbon steel surfaces in water-carrying systems, and to compositions for use in such a method, particularly where the water of the system is oxygen-bearing. More particularly, the present invention relates to the use of compositions comprising a combination of aminomethylphosphonic acid compounds and polymaleic anhydride or amine adducts thereof, and optionally zinc, to inhibit the corrosion of low carbon steel surfaces in water-carrying systems.

The term "aqueous", as used herein, is intended to describe water in any physical state and to include water in which is dissolved or dispersed any substance, for example, inorganic salts in brine or seawater.

Polymaleic anhydride, as used herein, is intended to include hydrolyzed polymaleic anhydride, which is essentially polymaleic acid. Under most ambient conditions, such hydrolysis to the acid form will take place.

Corrosion of low carbon steel surfaces in a water-carrying system consists of the destruction of the metal by chemical or electrochemical reaction of the metal with its immediate environment.

Where the corrosion is electrochemical in nature, a transfer or exchange of electrons is necessary for the corrosion reaction to proceed. When corrosion of the metal takes place, two partial electrochemical processes occur, and must occur, simultaneously. There is an anodic oxidation reaction in which metal ions go into solution, leaving behind electrons; and a cathodic reduction reaction in which species in solution are reduced by consuming the electrons produced by the anodic reaction. Where the water system contains oxygen, these two processes may be illustrated by the following equations:

Anodic oxidation: $Fe \rightarrow Fe^{++} + 2e^-$

Cathodic reduction: $2H_2O + O_2 + 4e^- \rightarrow 4OH^-$

The two ionic reaction products, ferrous ion and hydroxyl ion, combine to form ferrous hydroxide, $Fe(OH)_2$, which is then oxidized to form rust, ferric hydroxide, $Fe(OH)_3$. The principal factors influencing the corrosion process are the characteristics of the water of the system, the rate of water flow, the temperature of the system and the contact of dissimilar metals in the system. The variable characteristics of the water which determine its corrosiveness are its dissolved oxygen concentration, carbon dioxide content, pH and concentration of dissolved solids.

The presence of oxygen dissolved in the water of a system is primarily the result of contact of the water with the atmosphere. The oxygen solubility in water is temperature and pressure dependent, with an increase in pressure increasing solubility, and with an increase in temperature lowering the oxygen solubility.

Corrosion produced by the presence of oxygen in the water of a system can take place in the form of small pits or depressions besides general metal loss. As the corrosive process continues, these pits or depressions increase in area and depth and a nodule of corrosion products is formed. The corrosive attack is more severe when taking place in the form of pits or depressions since this permits deeper penetration of the metal and more rapid failure at these points.

2. Description of the Prior Art

Heretofore polymaleic anhydride and copolymers and derivatives thereof have been employed as scale inhibiting agents. See, for example, U.S. Pat. Nos. 2,723,956; 3,289,734; 3,293,152; 3,578,589; and 3,715,307. Inorganic polyphosphates have been similarly employed. See, for example, U.S. Pat. Nos. 2,358,222; 2,539,305; and 3,434,969.

A variety of compositions have been employed in the art for the purpose of inhibiting corrosion of surfaces in water-carrying systems where the cause of the corrosion is dissolved oxygen. Polyphosphates, for example sodium tripolyphosphate, are widely used in the treatment of once-through systems. See U.S. Pat. No. 2,742,369. Silicates, for example, sodium silicate, have also found acceptance.

U.S. Pat. No. 3,483,133 discloses a corrosion inhibiting composition comprising amino tris(methylenephosphonic) acid compounds in combination with water soluble zinc salts. U.S. Pat. No. 3,762,873 discloses a corrosion inhibiting method using substituted succinimides. Canadian Pat. No. 854,151 discloses a composition and method for inhibiting corrosion and/or the formation of calcium and magnesium containing scales where a combination of organophosphonic acid compounds and water soluble polymers having carboxyl or amide groups is employed. U.S. Pat. No. 3,810,834 discloses a method of treating the water of an aqueous system with hydrolyzed polymaleic anhydride having a molecular weight of 300 to 5,000 for the purpose of inhibiting scale formation; while U.S. Pat. Nos. 3,897,209; 3,963,636; and 4,089,796 disclose the use of the same hydrolyzed polymaleic anhydride material in combination with a zinc salt for the purpose of inhibiting both corrosion and scale formation.

U.S. Pat. No. 3,965,027 discloses certain amine adducts of polymaleic anhydride for use in scale inhibition and corrosion inhibition.

U.S. Pat. No. 4,105,581 discloses a corrosion inhibitor comprising a phosphate and phosphonate, which further includes a homopolymer of maleic acid or maleic anhydride.

However, none of the prior art described above in any way suggests the synergistic results obtained with the novel compositions of the present invention when used to inhibit corrosion of low carbon steel in an aqueous system.

SUMMARY OF THE INVENTION

The method of the present invention for inhibiting corrosion of low carbon steel in an aqueous system comprises the step of treating said system with 1.0 to 300 parts per million by weight of the total aqueous content of said system, of a composition comprising aminomethylphosphonic acid compounds and polymaleic anhydride or amine adducts thereof in a weight ratio of from 10:1 to 1:10. The corrosion inhibiting composition may optionally contain zinc.

The present invention also concerns the novel compositions used in the method of the present invention for inhibiting corrosion of low carbon steel in an aqueous system.

The aminomethylphosphonic acid compounds employed in the compositions of the present invention include aminomethylphosphonic acid, amino bis(methylphosphonic acid), amino tris(methylphosphonic acid), compounds containing the above amino forms, and salts of any of the above acids. Such compounds include compounds of the general formula:

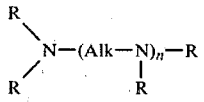

where Alk is any alkylene carbon group ($C_nH_{2n}$) containing 2 to 6 carbon atoms, each R may be H, —$CH_2$-COOM, or

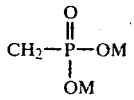

M is H or a cation forming a water-soluble salt and n=0 to 14 provided, however, that where n=0 at least one of the radicals represented by R are

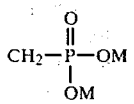

and where n is greater than zero at least ½ of the radicals represented by R are

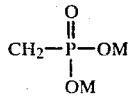

Ethylene diamine tetrakis (methylphosphonic acid) and its water-solube salts are preferred; amino tris(methylphosphonic acid) and its water-soluble salts are also preferred compositions. Of the monoamines containing only one or two methylphosphonate groups, the primary and secondary amines containing no other groups are preferred, i.e., those of the formula

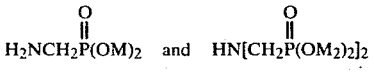

although substituted amines may also be used, such as, for example, diethanol amino(methyl phosphonates). Lower alkanol substituted monamines having at least one methyl phosphonate group are contemplated in the present invention. Compounds over the range n=0 to 14 may also be successfully used, included as representative compounds nitrilotris (methylphosphonic acid) in which n=0; ethylenediamine tetrakis (methyl phosphonic acid) in which n=1; diethylenetriamine pentakis (methyl phosphonic acid) in which n=2; pentamethylenehexamine octakis (methylphosphonic acid) in which n=5; and polyethyleneimine polykis (methylphosphonic acid) in which n=14.

The polymaleic anhydride material employed in the compositions of the present invention may be prepared by a number of different polymerization methods well known in the art. Such polymaleic anhydride may be hydrolyzed very readily, for example, by heating with water, to form a polymer which contains free carboxylic acid groups, and possibly some residual anhydride groups, on a carbon backbone. As indicated, the term polymaleic anhydride is used in this specification to indicate the polymeric product formed by hydrolyzing polymerized maleic anhydride.

The polymaleic anhydride employed in the compositions of the present invention should have a weight average molecular weight of from about 200 to about 10,000, and preferably not more than about 3,000.

Since polymerized maleic anhydride is so readily hydrolyzed, treatment of water or an aqueous system with polymerized maleic anhydride is the same as treatment with hydrolyzed polymaleic anhydride. Consequently, the present invention includes the use of such proportion of polymerized maleic anhydride as will yield the desired amount of hydrolyzed polymaleic anhydride on hydrolysis.

In addition to, or instead of, the polymaleic anhydride employed in the compositions and method of the present invention, there may be utilized amine adducts of polymaleic anhydride selected from the group consisting of:

A. polymers having recurring units of the formula:

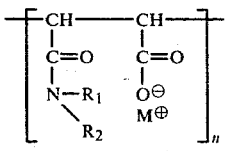

wherein $M^{\oplus}$ may be $H^{\oplus}$, alkali metal cation, or quaternary ammonium cation of the formula:

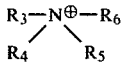

wherein for all of the above formulas, $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof; and wherein n is an integer of from 2 to 100; and B. polymers having recurring units of the formula:

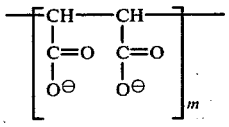

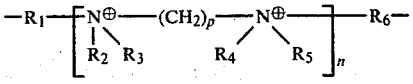

wherein $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof;

wherein p is an integer of from 1 to 6;

wherein m is an integer of from 2 to 100; and wherein n is an integer of from 2 to about 100, provided that, n not equal to m, the lesser of m or n is multiplied by a factor such that n=m.

Representative examples of the polymaleic anhydride amine adduct polymer compositions useful in the corrosion inhibiting method and compositions of the present invention are the following:

the mono-amido, ammonium salt of polymaleic anhydride, having recurring units represented by the following structural formula:

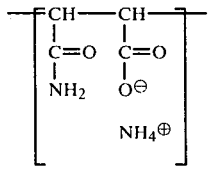

polymaleic anhydride sodium iminodiacetate having recurring units represented by the formula:

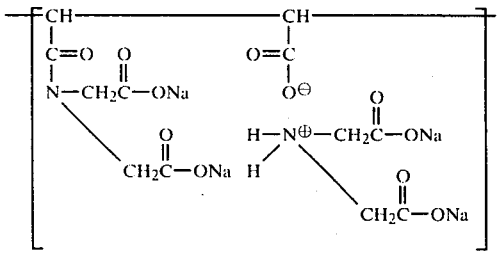

polymaleic anhydride ethanol amine adduct having recurring units of the formula:

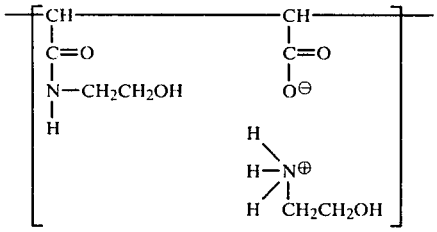

polymaleic anhydride diethanol amine adduct having recurring units of the formula:

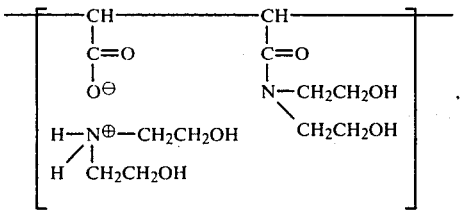

, and polymaleic acid N,N,N',N'-tetramethyl-diaminoethane ammonium salt having recurring units of the formula:

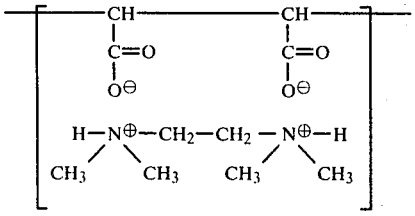

The amine adducts of polymaleic anhydride are preferably low molecular weight polymers having a weight average molecular weight of from about 200 to about 10,000. These polymer compositions are also preferably employed in their water soluble forms as, for example, the alkali metal or ammonium salts thereof. The makeup of these polymer compositions with respect to the proportionate amounts of the constituent maleic anhydride and amine groups present in the polymer chain may vary, such that the molar ratio of amine to maleic anhydride groups may be from about 0.1 to about 2.0.

The polymaleic anhydride and amine adducts of polymaleic anhydride employed in the compositions of the present invention may be employed as homopolymers, and may also be employed as random copolymers with acrylamide, which may comprise up to 40% of the total weight of the copolymer. Such copolymers are readily prepared by conventional methods well known in the art.

The aminomethylphosphonic acid compound of the composition of the present invention and the polymaleic anhydride or amine adducts thereof are combined in amounts such that the ratio of their respective weights will be from 10:1 to 1:10, preferably, from 3:1 to 1:3.

The corrosion inhibiting compositions of the present invention will be effective to inhibit the corrosion of the low carbon steel surfaces of an aqueous system being treated when the said compositions are added to the aqueous system in amounts sufficient to maintain within the said system a concentration level of corrosion inhibiting composition ranging between 1.0 to 300 parts per million (p.p.m.) by weight of the total aqueous content of the aqueous system being treated. Preferably, the concentration level range will be from 1.0 to 50 p.p.m.

The corrosion inhibiting compositions of the present invention are improved in their corrosion inhibiting performance by the addition thereto of zinc, which in an aqueous system will be active as zinc ion. The weight ratio of the combined aminomethylphosphonic acid and polymer components to the zinc component will be in the range of from 1:5 to 50:1, respectively, and preferably from 1:1 to 20:1. The zinc is calculated as $Zn^{++}$.

The zinc ion component of the corrosion inhibiting compositions of the present invention is provided by employing zinc in any convenient water soluble form, such as the chloride or the sulfate salt.

The present invention contemplates inclusion with the corrosion inhibiting compositions thereof other known additives for the treatment of aqueous systems. Particularly, other inhibitors may be included. For example, a copper corrosion inhibitor selected from the group consisting of 1,2,3-triazoles, thiols of thiazoles, oxazoles, and imidazoles as described respectively in U.S. Pat. Nos. 2,941,953 and 2,742,369 may be employed in an amount of up to about 10% by weight.

Other compositions, such as those described above with respect to the prior art, may be employed.

The compositions of the present invention will actively inhibit corrosion so long as they are effectively present in the aqueous system being treated. This effective presence is dependent on the lack of any degradation or decomposition of the inhibitor compositions occassioned by pH, temperature, pressure, or other conditions. Thus, it is anticipated that the inhibitor compositions of the present invention will be effective generally in a pH range of from about 6 to about 10.

While polymaleic anhydride is itself not water soluble until hydrolyzed to the acid form, the amine adducts of polymaleic anhydride are water soluble. Thus, they are readily introduced into an aqueous system to be treated in any suitable manner known to the art.

The polymaleic anhydride amine adducts employed in the compositions of the present invention may be prepared in accordance with the procedures described in U.S. Pat. No. 3,965,027.

The corrosion inhibiting compositions of the present invention are synergistic in their activity, i.e., they possess a degree of corrosion inhibiting activity which is greater than the corrosion inhibiting activity of either component alone.

The following example illustrates the synergistic corrosion inhibiting activity of the compositions of the present invention.

EXAMPLE

The coupon immersion test consisted of a cylindrical battery jar with a capacity of 8 liters. A Haake constant temperature immersion circulator (Model E-52) was used to control the solution temperature and agitate the controlled bath. Th unit contained a 1000 watt fully adjustable stainless steel heater which permitted temperature control to ±0.01° C., and a 10 liter per minute pump with a built-in pressure nozzle agitator that ensured high temperature uniformity in the bath. A mercury contact thermoregulator was used as the temperature sensing element.

The pH of the solution was controlled with a Kruger and Eckels Model 440 pH Controller. This unit was capable of turning power on and off to a Dias minipump whenever the pH of the corrosive liquid environment fell below the set point. The peristaltic Dias pump, with a pumping capacity of 20 ml. per hour, maintained the solution pH with the addition of sulfuric acid. Standard glass and saturated calomel electrodes were used as the sensing elements. The bath was continuously aerated through a medium porosity plastic gas dispersion tube to ensure air saturation.

Two SAE-1010 steel coupons, each having a surface area of 4.2 square inches, were suspended by a glass hook. The solution volume to metal surface area ratio for the test was approximately 1000:1.

The composition of the synthetic water used in the test was as follows; indicating content per liter of distilled water:

| Ion: | $Ca^{++}$ | $Mg^{++}$ | $HCO_3^-$ | $Cl^-$ | $SO_4^=$ |
|---|---|---|---|---|---|
| Mg./l.: | 88 | 24 | 40 | 70 | 328 |

That total hardness as $CaCO_3$ was 318 mg./l. and the pH was 7.0. The temperature was 50° C.

The test was conducted on the basis of a 2-6-6 day cycle: the system was pretreated with a higher concentration of the test corrosion inhibitor composition for a period of 2 days and then reduced to a lower maintenance level concentration; at the end of every 6 days after the initial 2 day period, the test solution was discharged and fresh solution was prepared containing the lower concentration of the test corrosion inhibitor composition; this was done for two 6 day periods. At the end of the 14 day cycle, the coupons were removed and analyzed and the test was terminated. The corrosion rate of the coupons was measured by their weight loss during the 14 day cycle, and the result was calculated as mils per year (mpy).

The test corrosion inhibitor compositions employed were as follows:

AMP—amino tris(methylphosphonic acid)

PMA—polymaleic anhydride; Ciba-Geigy BELGARD EV®

The results of the coupon corrosion tests are illustrated in the following table of values:

| Example No. | Corrosion Inhibitor Composition | Concentration (mg/l) Pre-treatment | Concentration (mg/l) Maintenance | AMP:PMA Ratio | Corrosion Rate mpy |
|---|---|---|---|---|---|
| Control | — | — | — | — | 68.8 |
| | | | | | 70.7 |
| 1 | AMP | 30.0 | 15.0 | 1.5:1 | 4.6 |
| | PMA | 20.0 | 10.0 | | 4.2 |
| 2 | AMP | 30.0 | 15.0 | 10:1 | 5.7 |
| | PMA | 20.0 | 1.5 | | 7.1 |
| 3 | AMP | 30.0 | 1.5 | 1:10 | 22.4 |
| | PMA | 20.0 | 15.0 | | 21.7 |
| 4 | AMP | 30.0 | 15.0 | | 16.3 |
| | | | | | 18.1 |
| 5 | AMP | 30.0 | 1.5 | | 41.5 |
| | | | | | 30.4 |
| 6 | PMA | 20.0 | 15.0 | | 30.1 |
| | | | | | 27.7 |
| 7 | PMA | 20.0 | 10.0 | | 35.0 |
| | | | | | 30.5 |
| 8 | PMA | 20.0 | 1.5 | | 32.7 |
| | | | | | 33.7 |

Obviously many modifications and variations of the invention as hereinabove set forth can be made without departing from the essence and scope thereof, and only such limitations should be applied as are indicated in the appended claims.

I claim:

1. A method of inhibiting corrosion of low carbon steel in an aqueous system comprising the step of treating said system with from 1.0 to 300 parts per million by weight of the total aqueous content of said system, of a corrosion inhibiting composition comprising (1) one or more aminomethylphosphonic acid compounds; and (2) one or more polymers selected from the group consisting of homopolymers, and random copolymers with acrylamide, of polymaleic anhydride and amine adducts of polymaleic anhydride selected from the group consisting of:

(a) polymers having recurring units of the formula:

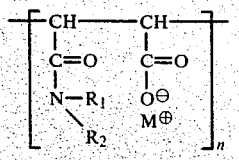

wherein $M^{\oplus}$ may be $H^{\oplus}$, alkali metal cation, or quaternary ammonium cation of the formula:

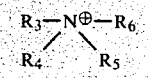

wherein for all of the above formulas, $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof; and wherein n is an integer of from 2 to 100; and (b) polymers having recurring units of the formula:

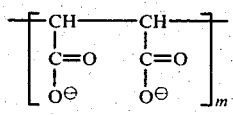

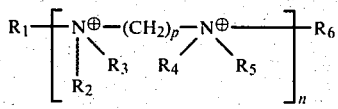

wherein $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof;

wherein p is an integer of from 1 to 6;

wherein m is an integer of from 2 to 100; and wherein n is an integer of from 2 to about 100, provided that, n not equal to m, the lesser of m or n is multiplied by a factor such that n=m;

wherein the polymaleic anhydride and amine adducts of polymaleic anhydride have a weight average molecular weight of from about 200 to about 10,000; and wherein the weight ratio of aminomethylphosphonic acid to polymer is from 10:1 to 1:10.

2. The method of claim 1 wherein said system is treated with from 1.0 to 50 parts per million by weight of the total aqueous content of said system, of said corrosion inhibiting composition.

3. A composition useful for inhibiting the corrosion of low carbon steel surfaces of aqueous systems, comprising (1) one or more aminomethylphosphonic acid compounds; and (2) one or more polymers selected from the group consisting of homopolymers, and random copolymers with acrylamide, of polymaleic anhydride and amine adducts of polymaleic anhydride selected from the group consisting of:

(a) polymers having recurring units of the formula:

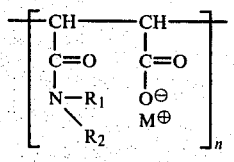

wherein $M^{\oplus}$ may be $H^{\oplus}$, alkali metal cation, or quaternary ammonium cation of the formula:

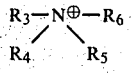

wherein for all of the above formulas, $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof; and wherein n is an integer of from 2 to 100; and (b) polymers having recurring units of the formula:

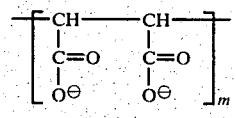

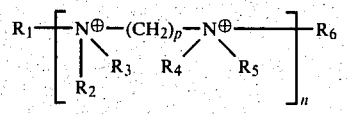

wherein $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof;

wherein p is an integer of from 1 to 6;

wherein m is an integer of from 2 to 100; and wherein n is an integer of from 2 to about 100, provided that, n not equal to m, the lesser of m or n is multiplied by a factor such that n=m;

wherein the polymaleic anhydride and amine adducts of polymaleic anhydride have a weight average molecular weight of from about 200 to about 10,000; and wherein the weight ratio of aminomethylphosphonic acid to polymer is from 10:1 to 1:10.

4. A method of inhibiting corrosion of low carbon steel in an aqueous system comprising the step of treating said system with from 1.0 to 300 parts per million by weight of the total aqueous content of said system, of a corrosion inhibiting composition comprising (1) one or more aminomethylphosphonic acid compounds (2) one or more polymers selected from the group consisting of homopolymers, and random copolymers with acrylamide, of polymaleic anhydride and amine adducts of polymaleic anhydride selected from the group consisting of:

(a) polymers having recurring units of the formula:

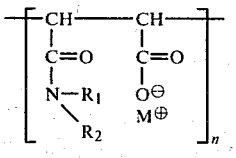

wherein M⊕ may be H⊕, alkali metal cation, or quaternary ammonium cation of the formula:

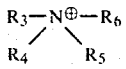

wherein for all of the above formulas, $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof; and wherein n is an integer of from 2 to 100; and (b) polymers having recurring units of the formula:

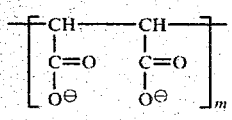

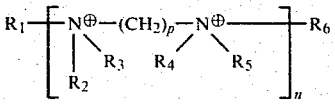

wherein $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof;

wherein p is an integer of from 1 to 6;

wherein m is an integer of from 2 to 100; and wherein n is an integer of from 2 to about 100, provided that, n not equal to m, the lesser of m or n is multiplied by a factor such that n=m;

wherein the polymaleic anhydride and amine adducts of polymaleic anhydride have a weight average molecular weight of from about 200 to about 10,000; and wherein the weight ratio of aminomethylphosphonic acid to polymer is from 10:1 to 1:10; and (3) zinc;

wherein the weight ratio of the combined aminomethylphosphonic acid and polymer components to the zinc component is from 1:5 to 50:1.

5. The method of claim 4 wherein the weight ratio of the combined aminomethylphosphonic acid and polymer components to the zinc component is from 1:1 to 20:1.

6. A composition useful for inhibiting the corrosion of low carbon steel surfaces of aqueous systems, comprising (1) one or more aminomethylphosphonic acid compounds;

(2) one or more polymers selected from the group consisting of homopolymers, and random copolymers with acrylamide, of polymaleic anhydride and amine adducts of polymaleic anhydride selected from the group consisting of:

(a) polymers having recurring units of the formula:

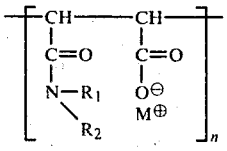

wherein M⊕ may be H⊕, alkali metal cation, or quaternary ammonium cation of the formula:

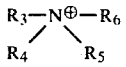

wherein for all of the above formulas, $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof; and wherein n is an integer of from 2 to 100; and (b) polymers having recurring units of the formula:

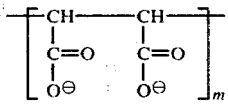

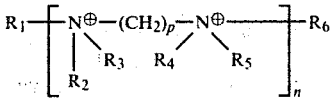

wherein $R_1$, $R_2$, $R_3$, $R_4$, $R_5$, and $R_6$ are each independently selected from the group consisting of hydrogen, alkyl of from one to ten carbon atoms, and substituted alkyl of from one to ten carbon atoms, where the substituent is hydroxyl; carbonyl; and carboxylic acid groups, and alkali metal ion and ammonium salts thereof;

wherein p is an integer of from 1 to 6;

wherein m is an integer of from 2 to 100; and wherein n is an integer of from 2 to about 100, provided that, n not equal to m, the lesser of m or n is multiplied by a factor such that n=m;

wherein the polymaleic anhydride and amine adducts of polymaleic anhydride have a weight average molecular weight of from about 200 to about 10,000; and wherein the weight ratio of aminomethylphosphonic acid to polymer is from 10:1 to 1:10; and (3) zinc;

wherein the weight ratio of the combined aminomethylphosphonic acid and polymer components to the zinc component is from 1:5 to 50:1.

7. The composition of claim 6 wherein the weight ratio of the combined aminomethylphosphonic acid and polymer components to the zinc component is from 1:1 to 20:1.

* * * * *